US008276945B2

(12) United States Patent
Heim et al.

(10) Patent No.: US 8,276,945 B2
(45) Date of Patent: Oct. 2, 2012

(54) SECURITY ELEMENT PROVIDED WITH AN OPTICALLY-VARIABLE LAYER AND METHOD FOR THE PRODUCTION THEREOF

(75) Inventors: Manfred Heim, Munich (DE); Friedrich Kretschmar, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 1255 days.

(21) Appl. No.: 11/576,583

(22) PCT Filed: Oct. 6, 2005

(86) PCT No.: PCT/EP2005/010766

§ 371 (c)(1),
(2), (4) Date: Apr. 3, 2007

(87) PCT Pub. No.: WO2006/040069

PCT Pub. Date: Apr. 20, 2006

(65) Prior Publication Data

US 2007/0241553 A1 Oct. 18, 2007

(30) Foreign Application Priority Data

Oct. 7, 2004 (DE) ..... 10 2004 049 118

(51) Int. Cl.
*B42D 15/00* (2006.01)
*B42D 15/10* (2006.01)
*B42D 103/00* (2006.01)

(52) U.S. Cl. ..... 283/91; 283/94; 283/81; 283/85

(58) Field of Classification Search ..... 283/72, 283/81–83, 85, 87, 89, 91, 92, 94, 901, 902; 428/204, 212
See application file for complete search history.

(56) References Cited

U.S. PATENT DOCUMENTS

| | | | | |
|---|---|---|---|---|
| 3,858,977 | A | 1/1975 | Baird et al. | |
| 4,705,300 | A | 11/1987 | Berning et al. | |
| 4,705,356 | A | 11/1987 | Berning et al. | |
| 4,779,898 | A | 10/1988 | Berning et al. | |
| 6,036,232 | A | 3/2000 | Kaule et al. | |
| 6,236,510 | B1 * | 5/2001 | Bradley, et al. | 428/403 |

(Continued)

FOREIGN PATENT DOCUMENTS

CN 1922032 A 2/2007

(Continued)

OTHER PUBLICATIONS

International Search Report, International Application No. PCT/EP2005/010766, 4 pages, Jan. 20, 2006.

(Continued)

*Primary Examiner* — Dana Ross
*Assistant Examiner* — Pradeep C Battula
(74) *Attorney, Agent, or Firm* — Greenlee Sullivan P.C.

(57) ABSTRACT

The present invention relates to a security element for securing valuable articles, having an optically variable layer (20) that imparts different color impressions at different viewing angles. According to the present invention, in a covering area (32), a semi-transparent ink layer (34) is disposed on top of the optically variable layer (20), the color impression of the optically variable layer (20) being coordinated with the color impression of the semi-transparent ink layer (34) in the covering area (32) when viewed under predefined viewing conditions.

45 Claims, 4 Drawing Sheets

U.S. PATENT DOCUMENTS

Figure 1:
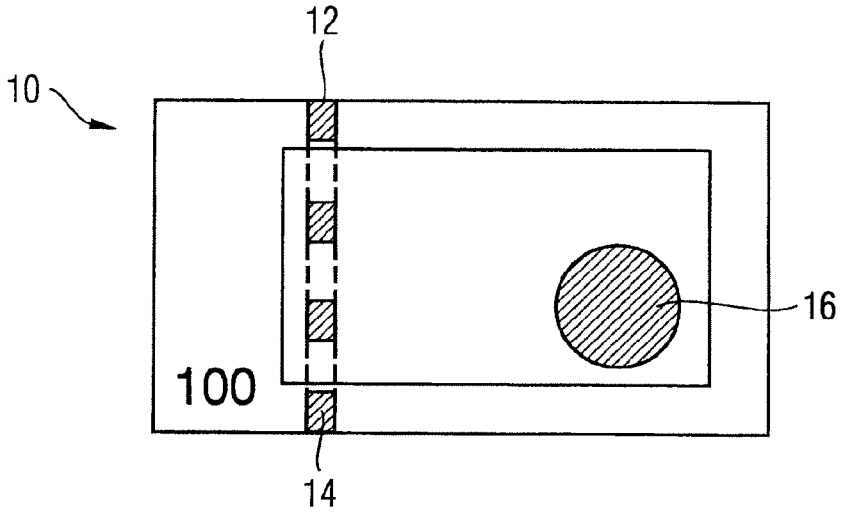

| | | | | |
|---|---|---|---|---|
| 6,686,027 | B1 * | 2/2004 | Caporaletti et al. | 428/195.1 |
| 6,761,959 | B1 * | 7/2004 | Bonkowski et al. | 428/156 |
| 6,841,238 | B2 * | 1/2005 | Argoitia et al. | 428/323 |
| 7,894,112 | B2 * | 2/2011 | Kaule et al. | 283/86 |
| 2004/0195823 | A1 * | 10/2004 | Yokote et al. | 283/72 |
| 2007/0165182 | A1 | 7/2007 | Hoffmuller | |
| 2007/0211238 | A1 | 9/2007 | Hoffmuller | |
| 2007/0216518 | A1 | 9/2007 | Hoffmuller | |
| 2007/0229928 | A1 | 10/2007 | Hoffmuller | |
| 2007/0241551 | A1 | 10/2007 | Heim | |
| 2007/0246933 | A1 | 10/2007 | Heim | |
| 2007/0273146 | A1 | 11/2007 | Davis et al. | |
| 2007/0274559 | A1 | 11/2007 | Depta | |
| 2008/0014378 | A1 | 1/2008 | Hoffmuller | |
| 2008/0054621 | A1 | 3/2008 | Burchard | |
| 2008/0079257 | A1 | 4/2008 | Fessl | |
| 2008/0088859 | A1 | 4/2008 | Depta | |
| 2008/0160226 | A1 | 7/2008 | Kaule | |
| 2008/0163994 | A1 | 7/2008 | Hoppe | |
| 2008/0198468 | A1 | 8/2008 | Kaule | |
| 2008/0216976 | A1 | 9/2008 | Ruck | |
| 2008/0250954 | A1 | 10/2008 | Depta | |
| 2008/0258456 | A1 | 10/2008 | Rahm | |

FOREIGN PATENT DOCUMENTS

| | | |
|---|---|---|
| DE | 19639229 | 6/1997 |
| EP | 0170439 | 2/1986 |
| EP | 0827457 | 12/1999 |
| WO | WO 96/39307 | 12/1996 |
| WO | WO 99/04983 | 2/1999 |
| WO | WO 00/50249 | 8/2000 |
| WO | WO 03/013871 | 2/2003 |
| WO | WO 03/068525 | 8/2003 |
| WO | WO 2005105473 | 11/2005 |
| WO | WO 2005105474 | 11/2005 |
| WO | WO 2005105475 | 11/2005 |
| WO | WO 2005108106 | 11/2005 |
| WO | WO 2005108108 | 11/2005 |
| WO | WO 2005108110 | 11/2005 |
| WO | WO 2006005434 | 1/2006 |
| WO | WO 2006015733 | 2/2006 |
| WO | WO 2006018171 | 2/2006 |
| WO | WO 2006018172 | 2/2006 |
| WO | WO 2006040069 | 4/2006 |
| WO | WO 2006056342 | 6/2006 |
| WO | WO 2006072380 | 7/2006 |
| WO | WO 2006087138 | 8/2006 |
| WO | WO 2006099971 | 9/2006 |
| WO | WO 2006119896 | 11/2006 |
| WO | WO 2006128607 | 12/2006 |
| WO | WO 2007006445 | 1/2007 |
| WO | WO 2007006455 | 1/2007 |
| WO | WO 2007076952 | 7/2007 |
| WO | WO 2007079851 | 7/2007 |
| WO | WO 2007115648 | 10/2007 |

OTHER PUBLICATIONS

International Preliminary Report on Patentability, International Application No. PCT/EP2005/010766, 7 pages.

* cited by examiner

SECURITY ELEMENT PROVIDED WITH AN OPTICALLY-VARIABLE LAYER AND METHOD FOR THE PRODUCTION THEREOF

CROSS-REFERENCE TO RELATED APPLICATIONS

This application is the U.S. National Stage of International Application No. PCT/EP2005/010766, filed Oct. 6, 2005, which claims the benefit of German Patent Application DE 10 2004 049 118.6, filed Oct. 7, 2004, both of which are hereby incorporated by reference to the extent not inconsistent with the disclosure herewith.

The present invention relates to a security element for securing valuable articles, having an optically variable layer that imparts different color impressions at different viewing angles. The present invention further relates to a method for manufacturing such a security element, a transfer element, a security paper and a valuable article having such a security element.

For protection, valuable articles such as branded articles and value documents are often equipped with security elements that permit the authenticity of the valuable article to be verified, and that simultaneously serve as protection against unauthorized reproduction. Valuable articles within the meaning of the present invention include especially banknotes, stocks, bonds, certificates, vouchers, checks, valuable admission tickets and other papers that are at risk of counterfeiting, such as passports and other identity documents, as well as product protection elements, such as labels, seals, packaging and the like. In the following, the term "valuable article" encompasses all such articles, documents and product protection means. The term "security paper" is understood to mean the not yet circulatable precursor to a value document.

The security elements can be developed, for example, in the form of a security thread embedded in a banknote, an applied security strip or a self-supporting transfer element, such as a patch or a label that, after its manufacture, is applied to a value document.

To prevent reproduction of the security elements even with top-quality color copiers, the security elements exhibit multiply optically variable elements that, from different viewing angles, convey to the viewer a different image impression and show, for example, a different color impression or different graphic motifs.

In this connection, it is known to use security elements having multilayer thin-film elements in which the color impression for the viewer changes with the viewing angle, and when the security feature is tilted, shifts for example from green to blue, from blue to magenta or from magenta to green. Such color changes when a security element is tilted are referred to in the following as color-shift effects.

Publication U.S. Pat. No. 3,858,977 describes such optical interference coatings having a color-shift effect in connection with security elements. Depending on the type and number of layers in the layer structure, two or more viewing-angle-dependent, different color effects can occur.

From publication WO 03/068525 A1 is known a security element for embedding in or applying on a security document. The security element exhibits a substrate having a reflection layer and, on each side of the reflection layer, an interference element having a color-shift effect. In addition, the security element can exhibit diffraction patterns and/or areas having inverse lettering.

A value document having an optically variable material in the security element is also described in publication WO 00/50249 A1. Here, the optically variable material is present in the form of interference layer material or of liquid crystal material that likewise imparts different color impressions at different viewing angles. An embodiment is described in which, in adjoining areas, two liquid crystal materials having thermochromic properties are used that, under normal ambient conditions, exhibit the same appearance, but when heated, each display a color shift to different colors.

If an area of a security element exhibits merely a simple color-shift effect, this effect is often only a little conspicuous and is easily overlooked as an authenticity feature. Two adjoining areas that each display a color-shift effect having a different color change are indeed more conspicuous, but are often felt by viewers to be confusing.

Based on that, the object of the present invention is to specify a generic security element having high counterfeit security that avoids the disadvantages of the background art.

This object is solved by the security element having the features of the main claim. A manufacturing method for the security element, a transfer element, a security paper and a valuable article having such a security element are specified in the coordinated claims. Developments of the present invention are the subject of the dependent claims.

According to the present invention, in a covering area, a semi-transparent ink layer is disposed over the optically variable layer, the color impression of the optically variable layer being coordinated with the color impression of the semi-transparent ink layer in the covering area when viewed under predefined viewing conditions. Here, the present invention is based on the idea of using a combination of two color areas that, from a certain viewing direction, seem very similar, and in which the color impression of one of the areas changes when tilted but the other area remains color constant. Such a combination appears optically attractive, is self-explanatory for the user, and furthermore, exhibits high counterfeit security.

The immediate proximity of the color-variable area and the color-constant area intensifies the optical conspicuousness and thus directs the viewer's attention to the security element. Here, the color-constant area simultaneously forms a visually stabilizing influence and a point of comparison for the color-variable area in the authenticity check. The combination of the two color effects in immediate proximity impedes reproduction of the security element, since freely available inks or foils having color-shift effects can no longer be used directly.

Compared with the use of opaque ink layers, the use of a semi-transparent ink layer effects a significantly stronger adaptation of the color impressions of the optically variable layer and of the covering area under the predefined viewing conditions. In particular, as explained in detail below, unavoidable color fluctuations in the optically variable layer can be detected within a production series and the brilliance and the gloss in the covering area adapted to the high values typical for optically variable layers.

In a preferred embodiment, in a spectral range in which the color impression of the optically variable layer is coordinated with the color impression of the semi-transparent ink layer, the semi-transparent ink layer exhibits a transmittance between 60% and 100%, particularly preferably between 80% and 100%.

The semi-transparent ink layer can be applied in different ways, advantageously it is imprinted on the optically variable layer, for example in a screen printing, intaglio printing, flexo printing or other suitable printing method.

To introduce additional features into the security element, in preferred embodiments, the semi-transparent ink layer is present in the form of characters, patterns or codes. The semi-transparent ink layer can also itself exhibit gaps in the form of patterns, characters or codes.

A particularly appealing effect can be achieved if the optically variable layer and the semi-transparent ink layer are coordinated with each other in such a way that, when the security element is viewed vertically, the color impression of the optically variable layer outside the covering area corresponds substantially to the color impression of the semi-transparent ink layer in the covering area. In this way, when viewed vertically, which often occurs when a security element applied to a valuable article is first perceived, the color-variable and the color-constant area first impart substantially the same color impression. When the security element is tilted, the color impression changes in the color-variable area, while it remains unchanged in the color-constant covering area.

Instead of a semi-transparent ink layer, the security element according to the present invention can also be furnished with a screened ink layer. In this way, compared with the use of contiguous opaque ink layers, an adaptation of the color impressions of the optically variable layer and the covering area under the predefined viewing conditions is likewise effected. Thus, with the aid of the screening, a kind of semi-transparency of the ink layer is produced such that also opaque ink layers can be used in the color-constant covering area. In preferred embodiments, the screened ink layer is present as a negative screen, a positive screen or a line grating.

The optically variable layer can consist of a single layer, but to achieve particularly attractive, optically variable effects, it is normally formed from multiple sub-layers.

In a preferred variant of the present invention, the optically variable layer is formed by a thin-film element that has a color-shift effect and that preferably includes a reflection layer, an absorber layer and a dielectric spacing layer disposed between the reflection layer and the absorber layer. In such thin-film elements, the color-shift effect is based on viewing-angle-dependent interference effects due to multiple reflections in the different sub-layers of the element. The path difference of the light reflected at the different layers depends, on one hand, on the optical thickness of the dielectric spacing layer that determines the distance between the absorber layer and the reflection layer, and on the other hand, it varies with each viewing angle.

Since the path difference lies in the magnitude of the wavelength of the visible light, due to destructive interference and amplification of certain wavelengths, an angle-dependent color impression results for the viewer. Through suitable choice of material and thickness of the dielectric spacing layer, a number of different color-shift effects can be designed, for example tilt effects, in which the color impression changes with the viewing angle from green to blue, from blue to magenta or from magenta to green.

Alternatively, the thin-film element can exhibit a layer structure that comprises, besides a reflection layer, a dielectric spacing layer that is formed, in part, to be absorptive. In this case, an additional absorber layer can be omitted.

The reflection layer of the thin-film element is preferably formed by an opaque or by a semi-transparent metal layer. As the reflection layer, a layer that is magnetic at least in some areas can be used, such that a further authenticity feature can be integrated without requiring an additional layer in the layer structure.

The reflection layer, too, can exhibit gaps in the form of patterns, characters or codes that form transparent or semi-transparent areas in the thin-film element. In the transparent or semi-transparent gap areas, the viewer is presented with a conspicuous contrast to the surrounding color-shift effect. In particular, the patterns, characters or codes can light up brightly in transmitted light when the thin-film element is applied to a transparent substrate.

The thin-film element can also be formed by stacked absorber layers and dielectric spacing layers, multiple absorber and spacing layers also being able to be stacked alternatingly. Instead of alternating absorber layers and dielectric spacing layers, exclusively dielectric spacing layers can also be provided, adjoining layers having strongly different refractive indices so that a color-shift effect is produced. Here, the refractive indices of the adjoining dielectric spacing layers expediently differ by at least 0.03.

The dielectric spacing layer is preferably formed by a printing layer or by an ultrathin foil, especially a stretched polyester foil.

Alternatively or in addition to gaps in the reflection layer, also the absorber layer and/or the spacing layer can exhibit gaps in the form of patterns, characters or codes. No color-shift effect occurs in the gap areas of the absorber layer or of the spacing layer.

The thin-film element formed from sub-layers can also be present in the form of pigments or particles that have a suitable particle size, distribution and form factor and that can be added to other materials, especially a printing ink.

In another, likewise preferred variant of the present invention, the optically variable layer includes one or more layers composed of liquid crystal material, especially composed of cholesteric liquid crystal material. Here, the liquid crystal material is expediently present as a liquid crystal polymer material or in the form of pigments embedded in a binder matrix.

In a further, likewise advantageous variant of the present invention, the optically variable layer is formed by a diffraction pattern. In this variant, the diffraction pattern and the semi-transparent ink layer are advantageously coordinated with each other in such a way that, when viewed at a predefined, non-vertical viewing angle, they evoke substantially the same color impression. The security element according to the present invention then, when viewed vertically, shows the viewer first two different color impressions that, when tilted, adapt to one another until the color impressions of the color-variable and the color-constant area match in the predefined viewing direction.

In an advantageous embodiment, the diffraction pattern forms a grating image for depicting a true color image that exhibits a plurality of true color regions that shine in a desired true color when the grating image is illuminated.

Grating patterns having a given grating constant diffract only light of a certain wavelength in the viewing direction such that the grating fields covered with a uniform grating pattern always shine in one of the spectral colors. To be able to render colors that occur in nature, the so-called true colors, with grating images, these true colors are rendered as a mixture of certain primary colors. Since the human eye possesses three different cone systems with overlapping sensitivity ranges in the red, green and blue part of the visible spectrum, it is a common approach to choose the colors red, green and blue as primary colors. In the true color areas of a grating image, small sub-areas are then defined into which, for example, three different gratings are introduced that diffract red, green and blue light in the desired viewing direction. Here, the surface percentages covered with the grating patterns are chosen in accordance with the red, green and blue percentages of each of the true colors.

In a development of the present invention, the security element includes at least one further layer provided with a security feature. The at least one further layer can advantageously comprise an optically effective microstructure that is disposed below the layer structure composed of the optically variable layer and the semi-transparent ink layer. In particular, the optically effective microstructure can be formed as a diffraction pattern. In this way, it is possible to realize color-shift holograms, for example, in which the color-shift effect of the optically variable layer is combined with a holographic effect. Alternatively, the optically effective microstructure can also be a matte pattern that displays no diffractive effects when viewed, but rather merely has a scattering effect. In a further advantageous embodiment, the optically effective microstructure can be formed by an arrangement of micro-mirrors, microlenses or the like.

To facilitate an automatic authenticity check and, if applicable, further sensor-based detection and processing of the valuable articles furnished with the security element, the at least one further layer can also include machine-readable feature substances, especially magnetic, electrically conductive, phosphorescent, fluorescent or other luminescent substances.

In an advantageous embodiment, the security element exhibits a substrate on which the optically variable layer and the semi-transparent ink layer are disposed. This substrate can especially be formed by a plastic foil.

Preferably, the security element is a security thread, a security band, a security strip, a patch or a label for application to a security paper, value document or the like.

The present invention also includes a method for manufacturing a security element of the kind described above in which, in a covering area, a semi-transparent ink layer is disposed on top of an optically variable layer that imparts different color impressions at different viewing angles. Here, when viewed under predefined viewing conditions, the color impression of the optically variable layer is coordinated with the color impression of the semi-transparent ink layer in the covering area.

Advantageously, in the method according to the present invention, the semi-transparent ink layer is imprinted on the optically variable layer. It is appropriate to apply, especially to imprint, the optically variable layer itself on a substrate. If a transparent substrate is used, it is also possible to first print on this with the semi-transparent ink layer, on which, in turn, the optically variable layer can then be applied, especially imprinted.

In advantageous developments, the optically variable layer and/or the semi-transparent ink layer are provided with gaps in the form of patterns, characters or codes.

The present invention further comprises a transfer element, for application to a security paper, value document or the like, that is furnished with a security element of the kind described above. The transfer element preferably exhibits a substrate foil on which the security element is prepared in the reverse order of how it later comes to lie on the security paper or the valuable article and, subsequently, in a hot embossing process, is transferred to the security paper or the valuable article in the desired outline contours by means of a bonding layer, e.g. adhesive or lacquer layer. It is thus appropriate to first apply, especially to imprint, the semi-transparent ink layer on the substrate foil. The optically variable layer is then advantageously imprinted on the semi-transparent ink layer. Alternatively, the optically variable layer can also be vapor deposited or applied in another suitable manner. After the transfer, the separate substrate foil can then be removed from the layer structure of the security element. Alternatively, as a fixed component of the security element, the substrate foil can remain on the layer structure as a protective layer. Optionally, a release or separation layer, e.g. a wax, can be provided between the security element and the substrate foil.

A security paper for manufacturing security documents, such as banknotes, identity cards and the like, is preferably furnished with a security element of the kind described above. In particular, the security paper can comprise a carrier substrate composed of paper or plastic.

The present invention also includes a valuable article, such as a branded article, a value document or the like, that is provided with a security element described above. The valuable article can especially be a security paper, a value document or a product packaging.

Further exemplary embodiments and advantages of the present invention are explained below by reference to the drawings, in which a depiction to scale and proportion was omitted in order to improve their clarity.

Figure 2:
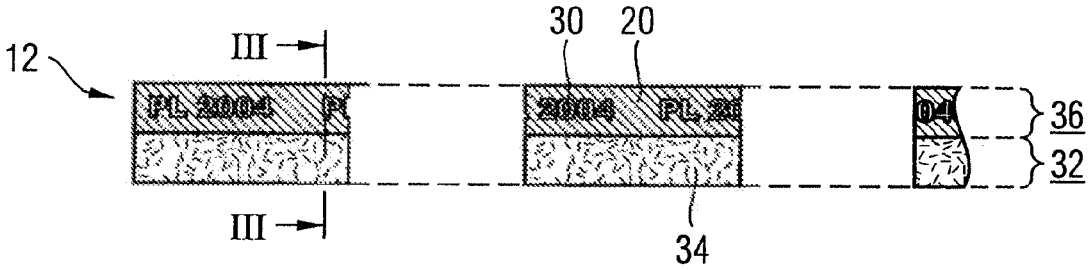
Figure 3:
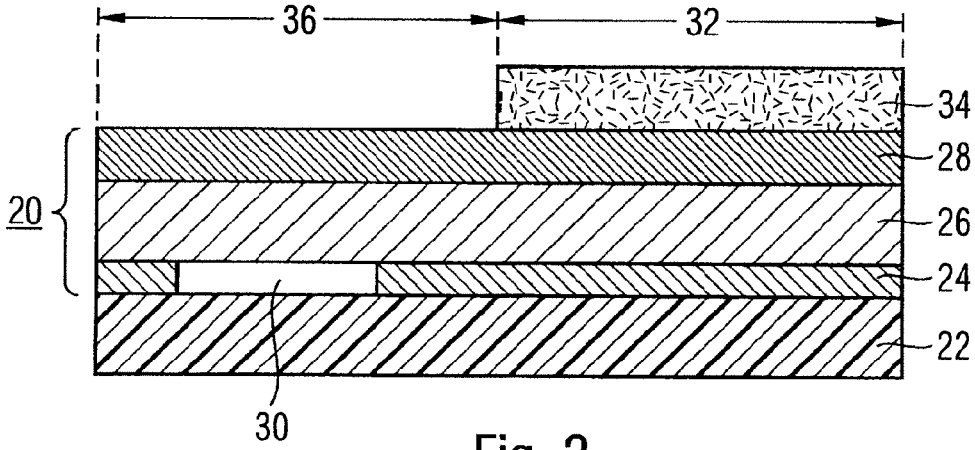
Figure 4:
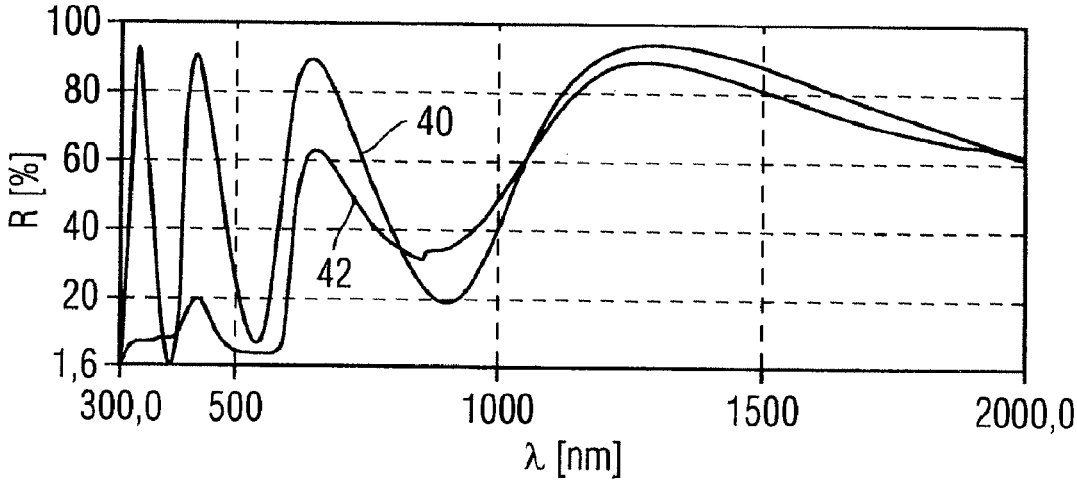
Figure 5:
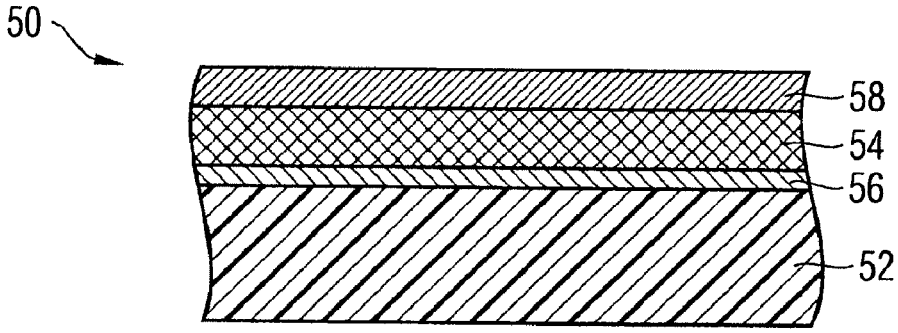
Figure 6:
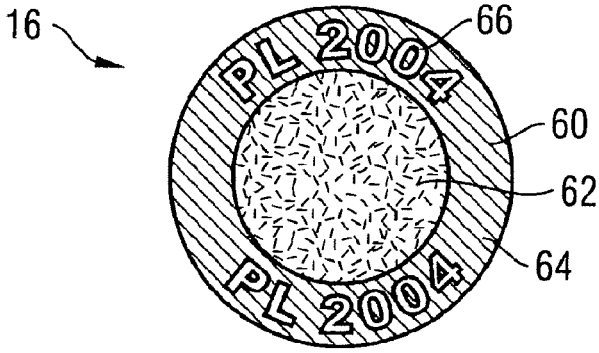
Figure 7:
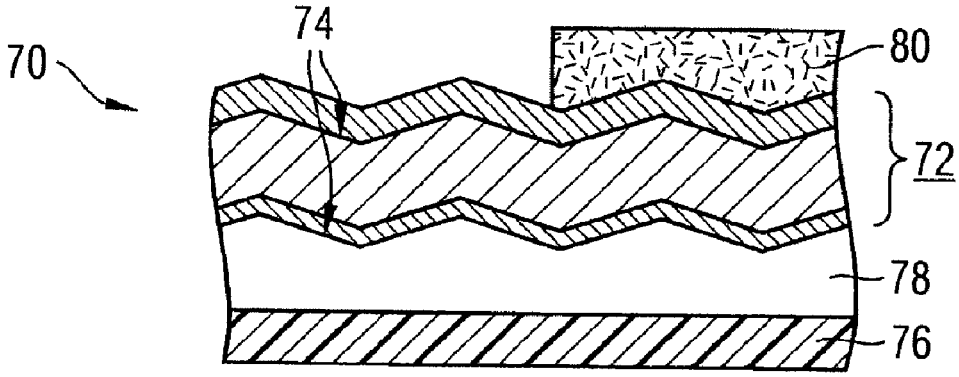
Figure 8:
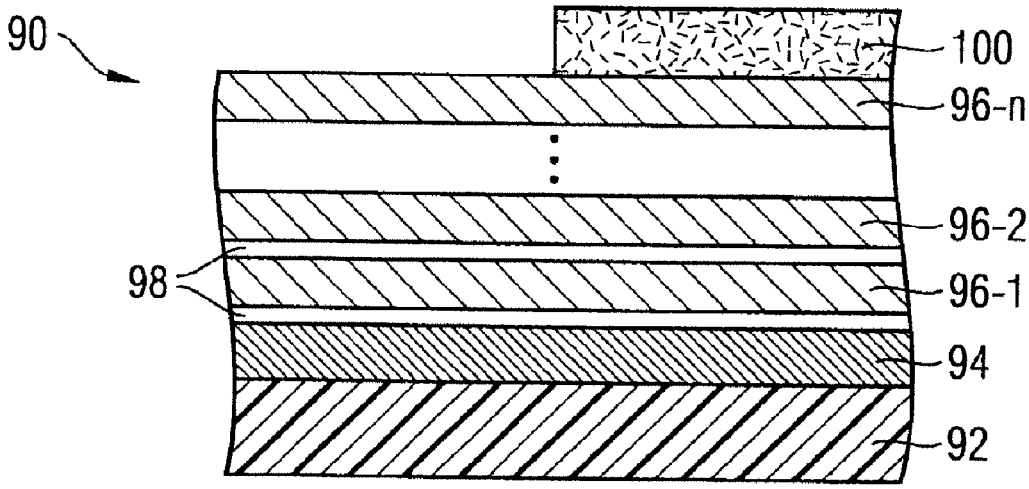
Figure 9:
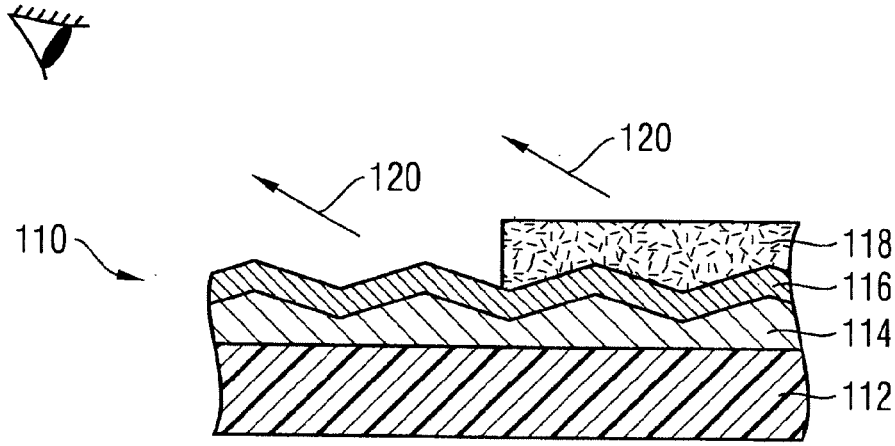
Figure 10:
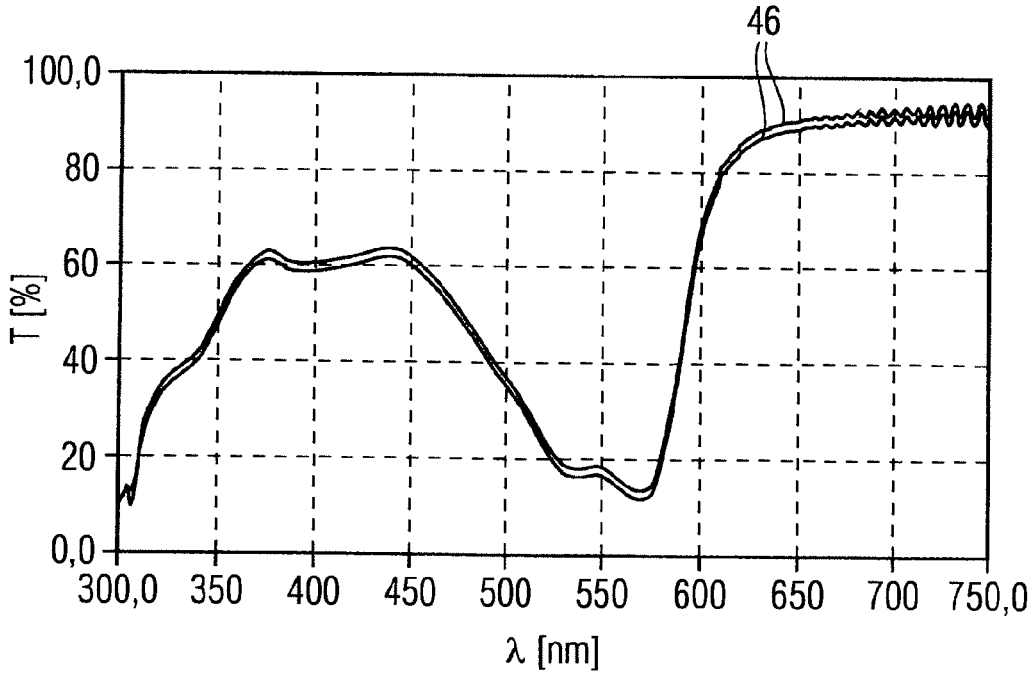

Shown are:

FIG. 1 a schematic diagram of a banknote having an embedded security thread and an affixed transfer element, each according to an exemplary embodiment of the present invention, FIG. 2 a top view of a sub-area of the security thread in FIG. 1, FIG. 3 a cross section through the security thread in FIG. 2 along the line III-III, FIG. 4 a diagram that shows the reflection spectra of a thin-film element, alone and after imprinting of a semi-transparent ink layer in the wavelength range $\lambda$ from 300 nm to 2,000 nm, FIG. 5 a cross section through a transfer material according to the present invention, FIG. 6 a more precise diagram of the transfer element in FIG. 1, viewed from above, FIG. 7 a hologram security thread according to a further exemplary embodiment of the present invention, in cross section, FIG. 8 the layer structure of a security element according to the present invention, having a liquid crystal structure as the optically variable layer, and FIG. 9 the layer structure of a security element according to the present invention, having a diffraction pattern as the optically variable layer, FIG. 10 a diagram that shows the transmission spectrum of a transparent plastic foil printed on with a semi-transparent ink layer in the wavelength range $\lambda$ from 300 nm to 750 nm.

The invention will now be explained in greater detail using a banknote as an example. For this, FIG. 1 shows a schematic diagram of a banknote 10 having two security elements 12 and 16, each of which is formed according to an exemplary embodiment of the present invention. The first security element constitutes a security thread 12 that emerges at certain window areas 14 on the surface of the banknote 10, while it is embedded in the interior of the banknote 10 in the areas lying therebetween. The second security element is formed by an affixed transfer element 16 of any shape.

The structure of the security thread 12 will now be explained in greater detail with reference to FIGS. 2 and 3. Here, FIG. 2 shows a top view of a sub-area of the security thread 12, and FIG. 3 depicts a cross section through the security thread along the line III-III in FIG. 2.

The security thread 12 includes a thin-film element 20 that has a color-shift effect and that is applied on a transparent substrate foil 22. The optically variable thin-film element 20 comprises a reflection layer 24 formed by an opaque aluminum layer, an ultrathin spacing layer 26 applied to the reflection layer, and a semi-transparent absorber layer 28, e.g. composed of chrome. As explained above, the color-shift effect of the thin-film element 20 is based on interference effects caused by multiple reflections in the different sub-layers 24, 26, 28 of the element.

One half of the security thread 12 forms a covering area 32 in which a semi-transparent ink layer 34 is imprinted on the thin-film element 20. In the immediately adjoining, non-covered area 36, the optically variable layer 20 is present without an imprinted ink layer. Here, the thin-film element 20 and the ink layer 34 are coordinated with each other in such a way that, at a vertical viewing angle, they evoke substantially the same color impression. The color impression of the thin-film element 20 at a vertical viewing angle is also referred to in the following as the vertical tilt color.

When the security thread 12 is tilted, the color impression of the thin-film element 20 changes in the non-covered area 36, while the color impression in the covering area 32 remains nearly unchanged. Through such a combination of a color-variable area with a color-constant area in immediate proximity, the visual conspicuousness of the color-shift effect is even significantly intensified, since the human eye reacts more strongly to the color differences that occur than to the color change per se. The viewer's attention is thus drawn even more strongly to the security feature. Furthermore, the mode of action of the security element is self-explanatory such that it can easily be checked for authenticity by anyone without further effort.

The combination of a tranquilly colored element with a color-tilt element is generally perceived to be optically very appealing. For potential counterfeiters, the combination of the two color effects in immediate proximity means a significant impedance to reproduction, since freely available inks or foils having color-shift effects can no longer be used directly.

The inventive use of a semi-transparent ink layer 34 has multiple advantages that will be explained in detail below.

The use of a semi-transparent ink layer 34 leads to an additional adaptation of the color impression of the thin-film element 20 in the non-covered area 36 and of the color impression of the semi-transparent ink layer 34 in the covering area 32. While the chromaticity coordinate of the imprinted semi-transparent ink layer 34 can be set very precisely and reproducibly, the vertical tilt color in which the thin-film element appears at a vertical viewing angle normally varies somewhat from security element to security element due to production fluctuations. These color fluctuations, which stem from the extremely high sensitivity of the ink that is visible at a vertical angle to the layer thickness of the dielectric spacing layer, are indeed small, but absolutely perceptible with the naked eye.

If the ink layer 34 is formed according to the present invention to be semi-transparent, then the vertical tilt color of the thin-film element 20 partially shows through the ink layer 34 and contributes to the aggregate color impression of the security element in the covering area 32 when viewed vertically. If the vertical tilt color in the non-covered area 36 of the thin-film element 20 now varies somewhat from security element to security element, then, due to the component that shows through, the color impression in the covering area 32 also changes accordingly. In this way, the overall color impression in the covering area 32 adapts to the color impression in the non-covered area 36.

The contribution of the vertical tilt color to the aggregate color impression is illustrated in the diagram in FIG. 4, which shows the reflection spectrum 40 of the thin-film element 20 in the non-covered area 36 at a vertical viewing angle. Likewise depicted is the reflection spectrum 42 of the combination of the thin-film element 20 and the semi-transparent ink layer 34 in the covering area 32. It is clearly recognizable that the color impression of the thin-film element 20 remains visible through the semi-transparent ink layer 34 and contributes to the overall color impression. In this way, for vertical viewing, it is possible to achieve excellent agreement of the color impressions in the two areas despite the unavoidable small thickness fluctuations in the spacing layer.

However, the semi-transparent ink layer 34 is highly sheer only when the viewing angle is nearly vertical. At an oblique viewing angle, it reflects significantly more light compared with vertical viewing, such that the light share of the underlying thin-film element 20 is thrust into the background.

In total, when viewed vertically, the color contribution of the thin-film element 20 that shows through in the covering area 32 contributes to the adaptation of the color impressions of the two adjoining areas. At an oblique viewing angle, the color contribution that shows through recedes into the background such that the color-constant contribution of the semi-transparent ink layer 34 then dominates the overall impression of the covering area 32.

The color contribution of the semi-transparent ink layer will now be explained in greater detail with reference to a transmission spectrum 46, illustrated in FIG. 10, of a transparent plastic foil printed on in color. In the red spectral range, the semi-transparent ink layer, in the example a red printing ink, exhibits very good transparency (about 90%) while, e.g. in the green spectral range at a wavelength of about 550 nm, it merely exhibits a transmittance of about 15%. The effect according to the present invention becomes effective precisely due to this different spectral transmission. In particular, the color impression of the semi-transparent ink layer in the covering area adapts well to an underlying tilt color that, for example, appears magenta at a vertical viewing angle, since the semi-transparent ink layer is nearly transparent in the relevant spectral range. If, in contrast, the security element is viewed at another tilt angle, then the color impression of the tilt color changes, for example, from magenta to green. In this wavelength range, the semi-transparent ink layer exhibits a substantially lower transparency such that the tilt color contribution that shows through recedes into the background and, instead, the color-constant contribution of the overlying ink layer dominates.

A further advantage of the use of semi-transparent ink layers consists in the adaptation of the brilliance of the two sub-areas 32 and 36. The reflection layer 24 of the thin-film element 20 is commonly designed such that it reflects about 90% of the incident light, so the color-shift effect appears very brightly and highly brilliant in the non-covered area 36. The luminance value, or the L-value in the CIELab color space, which indicates substantially the share of reflected light, is thus very high in the non-covered area 36. Common printing inks do not achieve such a high brilliance and such high L-values.

Thus, when an opaque printing ink is used for covering, the color impression of the vertical tilt color and the printing ink will be different even if the chromaticity coordinates (expressed by the red-green color information a and the blue-yellow color information b in the CIELab system) are nearly identical. When a semi-transparent ink layer is used, in the covering area 32, an additional light contribution of the thin-film element 20 is obtained such that its brilliance is increased and, in this way, the color impression of the non-covered area 36 is further approached.

Furthermore, the interference layer structure of the thin-film element 20 is extraordinarily smooth such that the non-covered area 36 also exhibits a high gloss and acts nearly like a colored mirror. Compared with this, the gloss of printing inks is substantially lower. In opaque printing inks, this gloss difference appears clearly for viewers even if the chromaticity coordinates (again expressed by a and b in the CIELab system) are nearly identical. By using a semi-transparent ink layer 34, the gloss in the covering area 32 increases thanks to the high-gloss thin-film element 20 that shows through, such that the visual impression for the viewer is adapted to the impression of the non-covered area 36.

In the exemplary embodiment in FIGS. 2 and 3, into the reflection layer 24 of the thin-film element 20 are also introduced gaps 30 that can form, for example, inverse lettering. The thin-film element 20 is transparent in the area of these gaps 30 such that, in addition to the described effects, a conspicuous contrast effect results in transmitted light.

If a security element, such as the transfer element 16 in FIG. 1, is applied in the form of a patch or strip to the valuable article to be secured, then it is expediently first prepared in the form of label material or transfer material, released in the desired shape and then transferred to the article to be secured. An example of such a transfer material is shown in FIG. 5 in cross section, and the released transfer element 16 affixed to a valuable article is depicted in FIG. 6, viewed from above.

The transfer material 50 includes a substrate layer 52, especially a plastic foil, to which the layer structure 54 composed of an optically variable layer and a semi-transparent ink layer is applied. Here, it can be advantageous to provide a separation layer 56 between the layer structure 54 and the substrate layer 52. On the layer structure 54 of the transfer material is provided an adhesive layer 58, for example a hot-melt adhesive layer, with which the security element can be fixed on the article to be secured.

For the transfer, the transfer material 50 is laid on the article and the adhesive layer 58 is activated, for example by heat. Subsequently, the substrate layer 52 is removed from the article such that only the affixed layer structure 54 remains on the article to be secured. Compared with the position in the transfer material 50, the layer sequence of the layer structure 54 is reversed by affixation to the article to be secured, such that, when the transfer material is manufactured, the semi-transparent ink layer lying on top on the article must be applied to the substrate layer 52 before the optically variable layer.

FIG. 6 shows the released and affixed transfer element 16, viewed from above. Like the security thread in FIGS. 2 and 3, the transfer element includes an optically variable thin-film element 60 having a color-shift effect and a semi-transparent ink layer 62 that is disposed over the thin-film element 60 in some areas.

In the exemplary embodiment, the thin-film element 60 and the ink layer 62 are formed by concentric discs, the semi-transparent ink layer 62 covering only the central, inner area of the thin-film element 60. In the outer, non-covered area 64 in which the thin-film element 60 is present without covering by an ink layer, into the reflection layer of the thin-film element 60 are introduced gaps 66 that, in transmitted light, show up brightly in the form of the lettering "PL 2004".

In this exemplary embodiment, too, the thin-film element 60 and the semi-transparent ink layer 62 are coordinated with each other in such a way that, at a vertical viewing angle, they evoke substantially the same color impression. The entire disc of the thin-film element 60 thus appears with a uniform color impression when viewed vertically. When the transfer element 16 is tilted, due to the color-shift effect of the thin-film element 60, the color impression of the outer, non-covered ring 64 changes, while the inner disc printed over with the semi-transparent ink layer 62 remains color constant.

The security element of the exemplary embodiment shown in FIG. 7 constitutes a hologram security thread 70 in which an optically variable layer having a color-shift effect is additionally provided with an areal optical microstructure. This microstructure can be, for example, a diffraction pattern 74. For this, an embossing lacquer layer 78 is applied on a substrate foil 76 in which the desired diffraction pattern 74 is embossed. The thin-film element 72, whose layer structure can be formed, for example, as in FIG. 3, is applied to the embossing lacquer layer 78.

A semi-transparent ink layer 80 is applied to a sub-area of the hologram security thread 70, and the semi-transparent ink layer 80 and the thin-film element 72 are coordinated with each other in such a way that, at a vertical viewing angle, they evoke substantially the same color impression. In addition to the effects described in connection with FIGS. 2 and 3, the hologram security thread 70 displays a holographic effect that is combined with the color-shift effect.

In the exemplary embodiments described so far, the optically variable layer is always formed by a thin-film element having a color-shift effect. However, the combination of optically variable layer and semi-transparent ink layer according to the present invention is not limited to such embodiments, but rather can likewise be used for all other types of optically variable layers, as shown below using the example of a liquid crystal structure (FIG. 8) and a diffraction pattern (FIG. 9).

For this, FIG. 8 shows the principle layer structure of a security element 90 according to the present invention, in which the optically variable layer includes one or more layers composed of liquid crystal material. For this, a smooth foil 92, for example a PET foil of good surface quality, is provided with an absorbent, dark background layer 94. To this background layer 94 is/are applied one or more layer/s 96-1, 96-2, . . . **96-*n* composed of a cholesteric liquid crystal material. Between the liquid crystal layers, alignment layers and/or adhesive layers 98** can be provided that serve to align the liquid crystals in the liquid crystal layers or to join the individual liquid crystal layers and compensate for surface irregularities in the background.

A sub-area of the security element 90 is provided with a semi-transparent ink layer 100. Here, the semi-transparent ink layer and the liquid crystal structure are coordinated with each other in such a way that, at a vertical viewing angle, they evoke substantially the same color impression. When the security element 90 is tilted, the liquid crystal structure presents the viewer with a changing color impression, while the color impression of the area provided with the ink layer 100 remains substantially constant.

In the security element 110 in FIG. 9, the optically variable layer is formed by a diffraction pattern that, when viewed under predefined viewing conditions, presents a certain color impression with which the semi-transparent ink layer is coordinated.

The security element 110 includes a base foil 112 and an imprinted, embossed and cured UV lacquer layer 114. In a subsequent evaporation step, the relief pattern of the lacquer layer 114 is provided with a thin reflective metal layer 116 or a dielectric layer such that, depending on the embossing, a diffraction pattern having the desired properties is created. For example, in diffuse illumination, the diffraction pattern can diffract red light in a predefined viewing direction 120. For illustration purposes, an oblique viewing direction 120 having a viewing angle of 60° to the vertical is shown in the figure.

In a sub-area, the diffraction pattern is provided with a semi-transparent ink layer 118, the semi-transparent ink layer 118 and the diffraction pattern being coordinated with each other in such a way that, when viewed from the predefined viewing direction 120, they evoke substantially the same color impression. In the exemplary embodiment, the semi-transparent ink layer 118 is chosen such that, in diffuse illumination, it likewise reflects red light in the viewing direction 120.

When viewed vertically, the security element 110 in FIG. 9 first shows the viewer two different color impressions. When the security element is tilted, the color impressions of the area covered with the ink layer and the uncovered area adapt to one another until, from the predefined viewing direction 120, they practically match. Through a suitable design of the diffraction pattern, a very narrow angle range can be set for the match of the color impressions such that a characteristic color effect that is difficult to imitate is created.

Of course, in addition to the layers described in the above exemplary embodiments, further layers can be present that were, however, omitted here for the sake of clarity. For example, the above layer structures can exhibit protective layers that are formed, for example, by a plastic layer or foil. Furthermore, the individual layers of the security elements, especially the optically variable layer and the semi-transparent ink layer, can be separated via further transparent layers, or be present on different sides of a transparent substrate foil.

The invention claimed is:

1. A security element for securing valuable articles, comprising an optically variable layer that imparts different color impressions at different viewing angles, wherein in a covering area, a semi-transparent ink layer is disposed on top of the optically variable layer, in a non-covered area, the optically variable layer is present without the semi-transparent ink layer, and the color impression of the optically variable layer is coordinated with the color impression of the semi-transparent ink layer in the covering area when viewed under predefined viewing conditions, such that the non-covered area forms a color variable area whose color impression changes when the security element is tilted, and the covering area forms a color-constant area which remains color constant when the security element is tilted; and wherein, when the security element is viewed vertically, the color impression of the optically variable layer outside the covering area corresponds substantially to the color impression of the semi-transparent ink layer in the covering area.

2. The security element according to claim 1, characterized in that, in a spectral range in which the color impression of the optically variable layer is coordinated with the color impression of the semi-transparent layer, the semi-transparent ink layer exhibits a transmittance between 60% and 100%.

3. The security element according to claim 1, characterized in that the semi-transparent ink layer is imprinted on the optically variable layer in the covering area.

4. The security element according to claim 1, characterized in that the semi-transparent ink layer is present in the form of characters, patterns or codes.

5. The security element according to claim 1, characterized in that the semi-transparent ink layer exhibits gaps in the form of characters, patterns or codes.

6. The security element according to claim 1, characterized in that the optically variable layer is formed from multiple sub-layers.

7. The security element according to claim 1, characterized in that the optically variable layer is formed by a thin-film element having a color-shift effect.

8. The security element according to claim 7, characterized in that the thin-film element includes a reflection layer, an absorber layer and a dielectric spacing layer disposed between the reflection layer and the absorber layer.

9. The security element according to claim 8, characterized in that the reflection layer is formed by an opaque or a semi-transparent metal layer.

10. The security element according to claim 8, characterized in that the reflection layer is present at least in some areas as a magnetic layer.

11. The security element according to claim 8, characterized in that the dielectric spacing layer is formed by a printing layer.

12. The security element according to claim 8, characterized in that the dielectric spacing layer is formed by an ultrathin foil.

13. The security element according to claim 8, characterized in that the reflection layer exhibits gaps in the form of patterns, characters or codes that form transparent or semi-transparent areas in the thin-film element.

14. The security element according to claim 8, characterized in that the absorber layer and/or the spacing layer exhibits gaps in the form of patterns, characters or codes in which no color-shift effect is perceptible.

15. The security element according to claim 8, characterized in that the thin-film element is present in the form of pigments or particles having a suitable size and form factor.

16. The security element according to claim 8, wherein the dielectric spacing layer is formed by a stretched polyester foil.

17. The security element according to claim 7, characterized in that the thin-film element includes a reflection layer and a dielectric spacing layer, the dielectric spacing layer being formed to be partially absorptive.

18. The security element according to claim 7, characterized in that the thin-film element includes at least one absorber layer and at least one dielectric spacing layer, the absorber layers and the dielectric spacing layers being stacked alternatingly.

19. The security element according to claim 7, characterized in that the thin-film element includes multiple dielectric spacing layers, adjoining layers of the dielectric spacing layers having highly different refractive indices.

20. The security element according to claim 19, characterized in that the refractive indices of the adjoining dielectric spacing layers differ by at least 0.03.

21. The security element according to claim 1, characterized in that the optically variable layer includes one or more layers composed of liquid crystal material.

22. The security element according to claim 21, characterized in that the liquid crystal material is present as a liquid crystal polymer material or in the form of pigments embedded in a binder matrix.

23. The security element according to claim 1, characterized in that the optically variable layer is formed by a diffraction pattern.

24. The security element according to claim 23, characterized in that the diffraction pattern forms a grating image for depicting a true color image that exhibits a plurality of true color regions that shine in a desired true color when the grating image is illuminated.

25. The security element according to claim 1, characterized in that the security element includes at least one further layer provided with a security feature.

26. The security element according to claim 25, characterized in that the at least one further layer comprises an optically effective microstructure that is disposed below the layer structure composed of the optically variable layer and the semi-transparent ink layer.

27. The security element according to claim 26, characterized in that the optically effective microstructure is a diffraction pattern, a matte pattern or an optically effective microstructure produced by micromirrors or microlenses.

28. The security element according to claim 25, characterized in that the at least one further layer includes machine-readable feature substances.

29. The security element according to claim 28, wherein the machine-readable feature substances are magnetic, electrically conductive, phosphorescent, fluorescent or other luminescent substances.

30. The security element according to claim 1, characterized in that the security element exhibits a substrate on which the optically variable layer and the semi-transparent ink layer are disposed.

31. The security element according to claim 30, characterized in that the substrate is formed by a plastic foil.

32. The security element according to claim 1, characterized in that the security element forms a security thread, a security band, a security strip, a patch or a label for application to a security paper, value document or the like.

33. A method for manufacturing the security element according to claim 1, in which, in a covering area, a semi-transparent ink layer is disposed on top of an optically variable layer that imparts different color impressions at different viewing angles, and in a non-covered area, the optically variable layer is provided without the semi-transparent ink layer, the color impression of the optically variable layer being coordinated with the color impression of the semi-transparent ink layer in the covering area when viewed under predefined viewing conditions, such that the non-covered area forms a color variable area whose color impression changes when the security element is tilted, and the covering area forms a color-constant area which remains color constant when the security element is tilted.

34. The method according to claim 33, characterized in that the semi-transparent ink layer is imprinted on the optically variable layer in the covering area.

35. The method according to claim 33, characterized in that the optically variable layer is applied to a substrate.

36. The method according to claim 33, characterized in that the optically variable layer and/or the semi-transparent ink layer is provided with gaps in the form of patterns, characters or codes.

37. A transfer element for application to a security paper, value document or the like, comprising the security element according to claim 1.

38. The transfer element according to claim 37, characterized in that the transfer element comprises a substrate foil.

39. A security paper for manufacturing security or value documents that is furnished with the security element according to claim 1 or a transfer element for application to a security paper, value document or the like, comprising said security element.

40. The security paper according to claim 39, characterized in that the security paper comprises a carrier substrate composed of paper or plastic.

41. A valuable article comprising the security element according to claim 1 or a transfer element for application to a security paper, value document or the like, comprising said security element.

42. The valuable article according to claim 41, characterized in that the valuable article is a security paper, a value document or a product packaging.

43. The security element according to claim 1, characterized in that, in a spectral range in which the color impression of the optically variable layer is coordinated with the color impression of the semi-transparent layer, the semi-transparent ink layer exhibits a transmittance between 80% and 100%.

44. A security element for securing valuable articles, comprising an optically variable layer that imparts different color impressions at different viewing angles, wherein in a covering area, a screened ink layer is disposed on top of the optically variable layer, and in a non-covered area, the optically variable layer is present without the screened ink layer, the color impression of the optically variable layer is coordinated with the color impression of the screened ink layer in the covering area when viewed under predefined viewing conditions, such that the non-covered area forms a color variable area whose color impression changes when the security element is tilted, and the covering area forms a color-constant area which remains color constant when the security element is tilted; and wherein, when the security element is viewed vertically, the color impression of the optically variable layer outside the covering area corresponds substantially to the color impression of the screened ink layer in the covering area.

45. The security element according to claim 44, characterized in that the screened ink layer exhibits a negative screen, a positive screen or a line grating.

* * * * *